United States Patent [19]

Noyon

[11] 4,397,601

[45] Aug. 9, 1983

[54] CONVERTIBLE RAIL-HIGHWAY VEHICLE

[75] Inventor: Gustave Noyon, Noisy-le-Grand, France

[73] Assignee: Societe d'Ingenierie des Transports, Paris, France

[21] Appl. No.: 222,927

[22] Filed: Jan. 6, 1981

[30] Foreign Application Priority Data

Jan. 14, 1980 [FR] France ..... 80 00705
May 6, 1980 [FR] France ..... 80 10077

[51] Int. Cl.[3] ..... B60P 1/61; B61D 3/16; B61F 1/00; B65G 67/02

[52] U.S. Cl. ..... 414/345; 105/159; 105/215 C; 105/404; 105/413; 410/44; 410/52

[58] Field of Search ..... 105/1 R, 159, 215 C, 105/404, 413; 410/44, 45, 52; 414/345, 396, 401

[56] References Cited

U.S. PATENT DOCUMENTS

| | | | |
|---|---|---|---|
| 1,670,907 | 5/1928 | Skooglun | 105/159 X |
| 2,043,034 | 6/1936 | Dalton | 105/215 C |
| 2,709,969 | 6/1955 | Andert | 105/215 C X |
| 2,800,086 | 7/1957 | Wike | 105/215 C X |
| 2,841,094 | 7/1958 | Schumacher | 105/215 C |
| 2,849,129 | 8/1958 | Likens | 414/401 X |
| 3,144,141 | 8/1964 | Tantlinger et al. | 410/52 X |
| 4,261,682 | 4/1981 | Papps et al. | 414/401 X |

FOREIGN PATENT DOCUMENTS

| | | | |
|---|---|---|---|
| 131157 | 8/1919 | United Kingdom | 414/345 |

*Primary Examiner*—Bruce H. Stoner, Jr.
*Assistant Examiner*—Howard Beltran
*Attorney, Agent, or Firm*—DeLio & Libert

[57] ABSTRACT

The present invention relates to a dismountable car for the technical coordination of rail-highway transport, wherein the car is adapted to support two identical loads and its chassis is in two elements respectively borne by the end bogies and provided with traction and buffer members, these two elements being connected in the median zone of the car by disconnectable connection means and their corresponding ends being adapted to be supported by retractable support devices which may rest via lower rail wheels on the rails and abut on these elements to maintain them substantially horizontal and lift or lower their free ends slightly.

7 Claims, 6 Drawing Figures

III
IV
II
18
7
8
10
2
4
3
1
28
27
29
6
5
20
21
19
9
24
25
26
22

CONVERTIBLE RAIL-HIGHWAY VEHICLE

The present invention relates to a dismountable car or truck for the technical coordination of rail-highway transport.

The technical coordination between rail and highway employing containers or boxes is, a priori, the best solution, as rail transport may be effected by means of flat-cars without having to convey road members.

However, this technique could only get started up only very recently, whilst the UFR (Union Fer et Route) technique has been exploited for forty six years and the "piggyback" technique for more than twenty years. These known techniques have developed as the rail transport of the road members rendered loading of the cars by rolling on the train easy.

On the contrary, the technique of transferring a mobile container or box from a car onto a road vehicle and vice versa must take the following imperatives into account:

the top of the empty car is 1195 mm away from the rails, whilst the top of a trailer chassis is 1450 to 1500 mm away from the ground at the location of the lower bolster and 1300 to 1350 mm at the rear end.

near the cross-members for coupling the car, the top part of the discs of the buffers projects from the flat top of the cars defined by the upper wall of the automatic coupling housing; moreover, no member for clearing the buffers can be permanently installed.

Consequently, it is virtually impossible to effect the longitudinal horizontal transfer of the boxes. In fact, this longitudinal horizontal transfer could only be envisaged at the end of a railway line raised with respect to the ground, on condition that a bridge is positioned above the buffers between the car and the road vehicle and that each box is slightly raised to clear the end obstacles of the car. Such an installation could only be used for isolated cars, which is incompatible with mass transport, or even diffuse transport.

Present techniques for transporting by mobile containers or boxes employ lifting means making it possible to transfer these boxes from the road vehicles to the cars, and vice versa. For average traffic, high capacity lift-trucks (lifting force 30 T with 2 m overhang) may be used; for heavy traffic, travelling gantry cranes, generally on rails, are permanently installed in order to straddle the railway and passage of the road vehicles. Investment in the installation of such equipment is very high; intense traffic is necessary for it to pay for itself profitably, and consequently the number of worksites thus equipped is limited. Light traffic and, a fortiori, diffuse traffic (isolated cars or cars grouped in two's or three's) are therefore excluded from the system.

Only horizontal or substantially horizontal handling is compatible with light transfer equipment and satisfies all traffic (diffuse or mass). Now, up to the present time, no one has managed to effect such a horizontal handling in satisfactory manner.

It is an object of the present invention to attain this goal and, to this end, its infrastructure comprises a working chassis adapted to support the load as well as the efforts of traction and collision with a buffer, this chassis being divided into at least two elements which are connected together by disconnectable connecting means; each chassis element is permanently carried at its so-called collision end, by a rolling element and, at its opposite, so-called separation end, and temporarily during transfer of the load, by a retractable support device enabling its loading surface to be maintained substantially horizontal as long as the transfer lasts during which said elements are spaced apart from each other; and each chassis element is equipped with means for longitudinally guiding the load cooperating with a means for traction thereof in both directions, whilst the support device cooperates with a low-amplitude lifting means, making it possible, in particular, to bring the separation end of the chassis element in question slightly above or below the end contiguous with the loading platform of the road vehicle for transferring a removable body from the car chassis element towards the platform of the road vehicle and from the latter towards the chassis element, respectively.

The means for connecting the two chassis elements are hooks fitting in one another by vertical translation to ensure locking, the means for lifting the retractable support device of one of said elements also enabling the hooks to be disconnected; the device for supporting each of the two chassis elements is equipped with rail wheels abutting on the railway and allowing each of said elements to move therealong; the traction means cooperating with the means for longitudinally guiding the load of each chassis element is constituted by drive wheels disposed near the separation end and adapted to receive their driving energy from the road vehicle; the means for longitudinally guiding the load of each chassis element comprise members for laterally centering the removable bodies.

The car is dismountable, with the result that, after having spaced apart at least one of the end rolling elements, the separation end of each chassis element is accessible for loading or unloading at the end.

When a road vehicle is brought into alignment against this free end of the car supported by its support device, said end may be brought, by its lifting means, slightly above or below the level of load of said vehicle to transfer a removable body from the car towards the vehicle and from the latter towards the car, respectively.

In any case, it is possible to integrate in the car and the road vehicle a simple handling device which makes it possible if the traffic is diffuse, to avoid any terminal transfer equipment (except for a section of embedded railway track which is found in virtually all stations), by using the longitudinal guiding device and the traction means provided to this end on said car and said road vehicle.

At the same time, the invention enables the number and geographical density of the termini able to be served by rail for coordination thereof with the highways, to be increased, it diversifies and simplifies the possibilities of manoeuvring in a terminus, it improves versatility of use, reduces the time of immobilisation both of the train and of the railway and consequently the duration of the rail-highway transfer, it reduces the length of embedded rail necessary and reduces the cost price of a completely equipped car, as well as terminal equipment for mass traffic.

The invention will be more readily understood on reading the following description with reference to the accompanying drawings, in which.

Figures 1, 2, 3, 4:
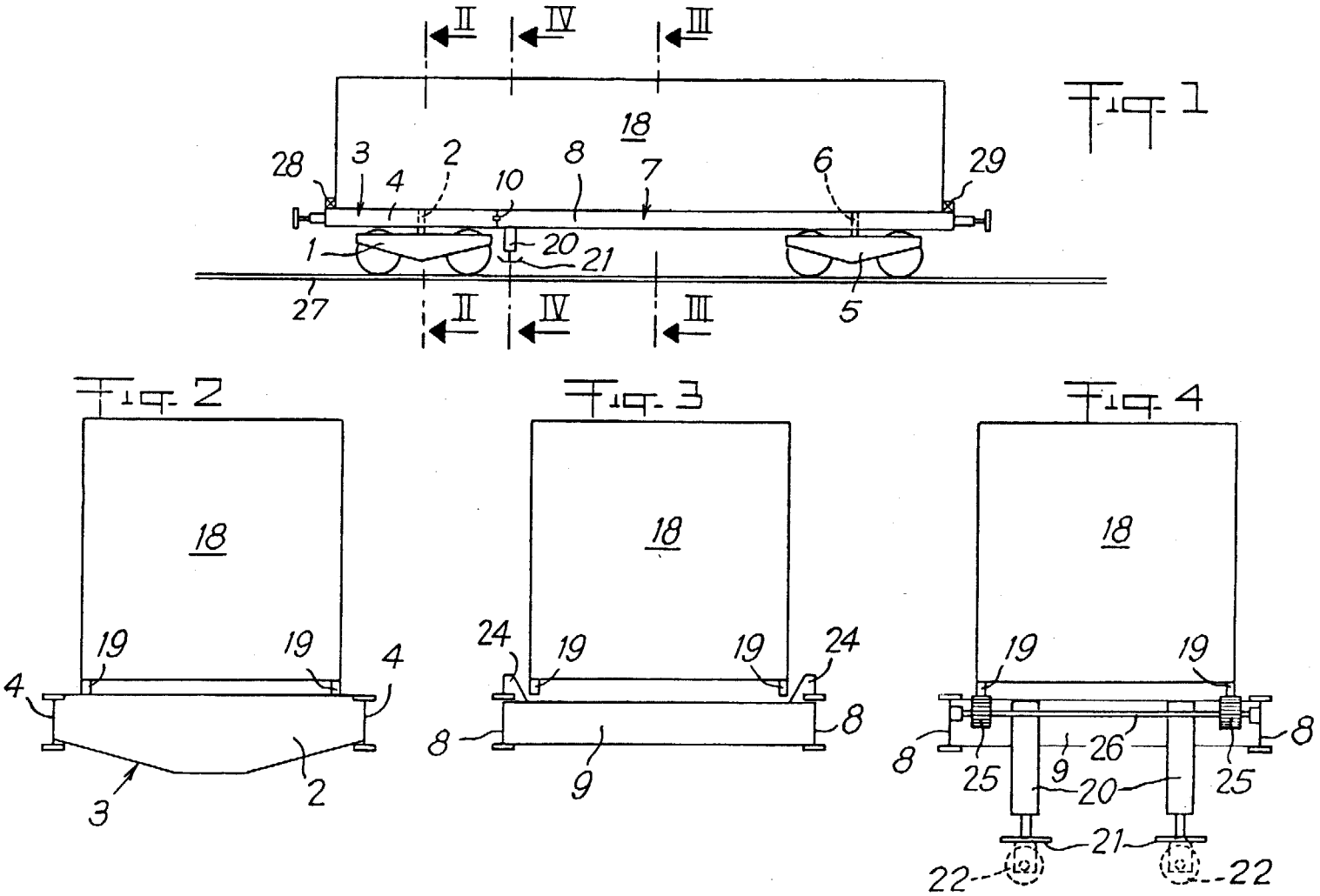
FIG. 1 is a view in elevation schematically showing a first embodiment of the car according to the invention.
FIGS. 2 to 4 are schematic cross sections taken, on a larger scale, along lines II—II to IV—IV of FIG. 1, respectively.

According to the first embodiment illustrated in FIGS. 1 to 4, the car comprises a first end bogie 1 of which the centre thrust bearing supports the cross member 2 of a short chassis element 3 presenting side-sills 4. The car comprises a secon ' end bogie 5 of which the centre pin hole supports a cross-member 6 belonging to a long chassis element of which the side-sills 8, connected together by suitably distributed cross members 9, are aligned with those 4 of the short chassis 3; the rigid connection of these side-sills is ensured by means of disconnectable connecting members 10 which may be of any type.

Figure 5:
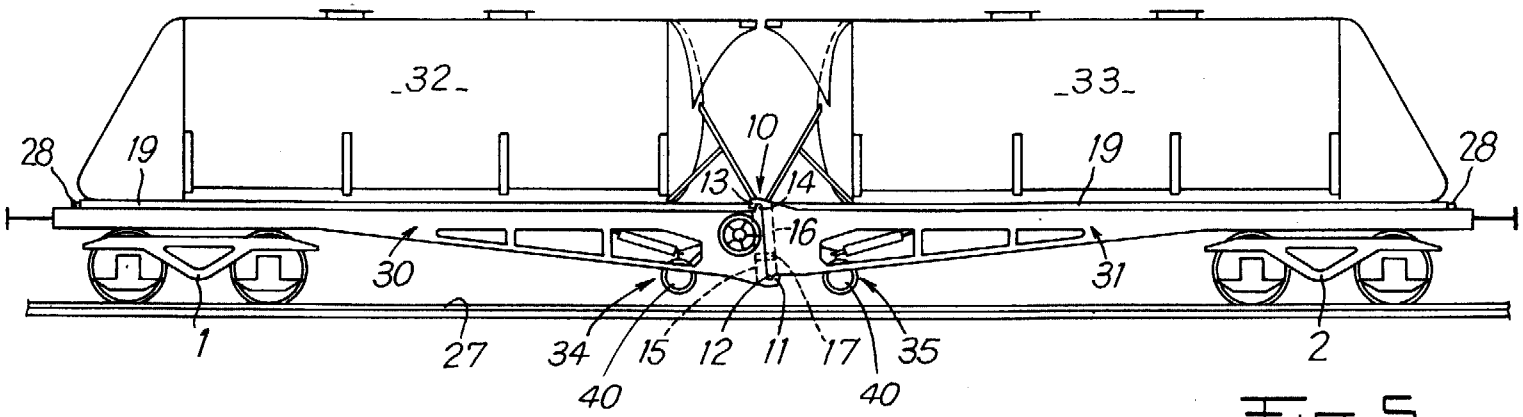
FIG. 5 is an elevation illustrating a second embodiment of the car according to the invention.

These disconnectable connecting members 10 are preferably constituted, as may be seen in the example shown schematically in FIG. 5 for the second embodiment, by at least:

one lower hook 11 fast with the short chassis element 3, upwardly open and cooperating with a corresponding tooth 12 projecting downwardly from the long chassis element 7 in its direction, an upper hook 13 fast with the long chassis element 7, open downwardly and cooperating with a corresponding tooth 14 projecting upwardly from the short chassis element 3.

and a locking member connecting together the end separation plates 15 and 16 of the chassis elements 3 and 7 when the hooks 11, 13 and the teeth 12, 14 with which they are fast, are fitted in one another by relative vertical translation and maintain the sloping contact faces of these plates strongly pressed against each other, the locking member advantageously being a cylindrical or conical pin 17 passing through the plates 15 and 16 and placed in functional control relation with the devices described hereinafter and coming into operation when the car is separated into two parts.

Of course, these disconnectable connecting members 10 may proceed differently for their positioning and withdrawal, by transverse or longitudinal translation, by pivoting or by more complex movements by cams.

The framework formed by the short chassis element 3 and the long chassis element 7 withstands the efforts of traction and collision with buffers, but it is not necessary for it to support the load of the removable body 18, as the latter is self-supporting and may rest on the cross members 2 and 6 by its skids or sideframes 19.

The long chassis element 7 is equipped, near its free so-called separation end, with a retractable support device which, in the example shown, is constituted by two independent prop elements 20 of which the shafts are fast with said structure and the piston rods are fast with skids 21 for fixed abutment on the ground or provided with swivelling and possibly self-driving wheels 22 (FIG. 4). When these props abut on the ground, they support the free separation end and maintain the long chassis element 7 substantially horizontal; by continuing their stroke on either side of this position of support, they form a low-amplitude lifting means, due to which the connecting members 10 may be disconnected and said free end of the long chassis element 7 may then be brought slightly above the platform of the road vehicle to load the removable body 18 coming from the rail car or slightly below so that this long chassis element 7 can be loaded with a removable body coming from a road vehicle.

Figure 6:
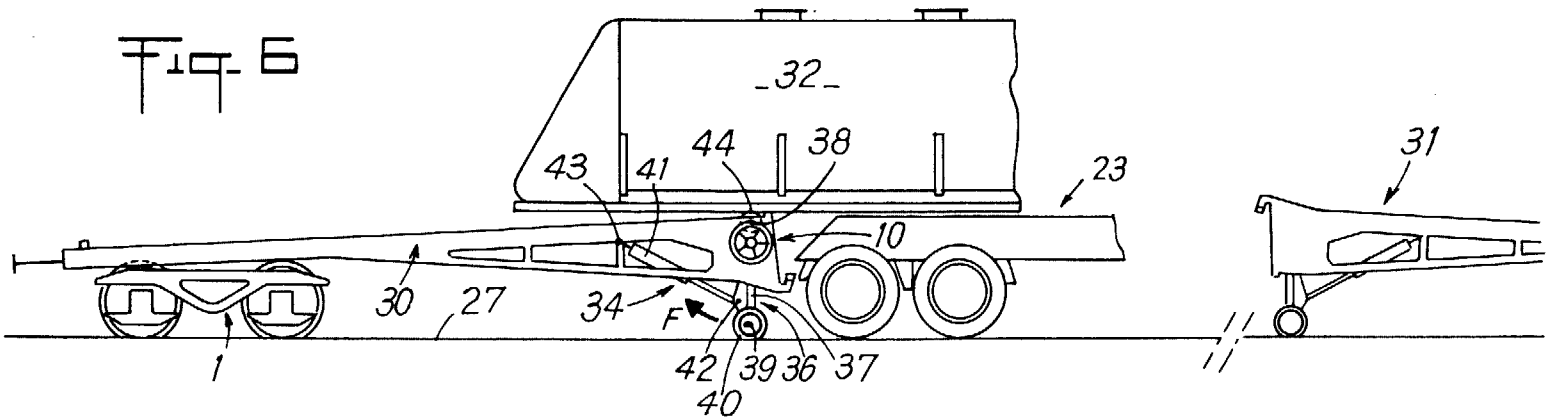
FIG. 6 is a part view similar to FIG. 5, showing the loading and unloading of an element of the isolated car.

The long chassis element 7 is also equipped with a longitudinal guide device for transferring the removable body 18 between this element and the bed of a trailer 23 (FIG. 6) and vice versa. This guiding device may be of any type and, as shown in FIGS. 3 and 4, it may be constituted by longitudinal guides 24 presenting lateral slopes to cooperate with the sideframes 19 of the removable body 18 and by at least one pair of rollers 25 borne, by means of a shaft 26, by the side-sills 8 of the long chassis element 7. These rollers, which are preferably driving ones for the traction of the removable body 18, are located slightly below the level of the cross members 2 and 6. Under these conditions, when the props 20 are retracted and the long chassis element 7 is locked at the end of the short chassis element 3 by the members 10, the removable body 18 rests solely on the cross members 2 and 6, being spaced apart from the rollers 25; on the contrary, when the props 20 are actuated to lift the front of the long chassis element 7, by abutting by their skids 21 on the ground, the long chassis element firstly begins by being unlocked from the short chassis element 3 and then places the rollers 25 in contact with the sideframes 19; the long chassis element 7 continues its forward lift, taking with it the removable body 18 and stops when its upper level is slightly higher than that of the trailer 23 (FIG. 6).

To effect transfer of the removable body onto the trailer, it suffices to displace the short end rolling element 1 to 4 along the railway line 27 to move it away from the long chassis element 7 and thus clear an area for manoeuvering. The trailer is then backed against the free separation end of this long element 7 and under the front of the body. Then, said body is displaced along the said guide device and conducted on the road trailer, using the motorised rollers 25 and/or a winch cable, the power being furnished by the tractor of the trailer.

Another type of longitudinal guiding device may comprise guides (not shown) which are fast with the chassis element 7 and on which the skids 19 of the removable body rest and slide with a certain lubrication. These guides may be replaced by guide paths of which at least certain of the rollers may be motorised and braked. In any case, whatever the type of longitudinal guiding employed, the device presents lateral centering members such as sloping stops, rollers with inclined axes, rotating conical stops, etc.

The removable body 18 is maintained in position by stops 28 and 29 located on the short chassis element 3 and the long chassis element 7 respectively. Of course, if the goods stored in this body are fragile, the stops are replaced by appropriate shock absorbers allowing a limited longitudinal displacement of said body.

According to the second embodiment illustrated in FIGS. 5 and 6, the car comprises two chassis elements 30 and 31 of equal lengths, adapted to support two identical removable bodies 32 and 33 respectively, in self-contained manner. These two elements are rigidly connected together, in particular to resist the efforts of traction and collision with buffers and to support the load, by the disconnectable connecting members 10 described hereinabove. At their other end, they are supported by bogies 1 and 2 respectively. They are equipped with the longitudinal guiding devices 19, 24 and the stops (or shock absorbers) 28, 29 mentioned hereinabove for the bodies 32 and 33, these means not being shown. They are also equipped with support and lifting devices 34 and 35 located near their separation ends.

These devices 34 and 35 may be of any type and in particular of the type, 20, described for the first embodiment. However, a preferred embodiment is illustrated in FIGS. 5 and 6; this embodiment is described for the device 34 associated with the chassis element 30, the description also applying the device 35.

Such a device 34 comprises a frame 36 presenting two legs 37 mounted to pivot, at their upper end, with respect to the side-sills of the chassis element 30 by means of pivot pins 38 located as near as possible to the disconnectable connecting means 10; at their lower end, the legs 37 support an axle 39 provided with self-driving rail wheels 40. For lifting or lowering the latter by pivoting the frame 36 in the direction of arrow F or in the opposite direction, this frame cooperates with at least one jack 41 of which the sliding parts are pivoted about pivot pins 42 and 43 belonging respectively to a bracket on said frame and to a tab on said side-sills of the chassis element 30. The pivot pin 43 is located, from the members 10, in the direction of bogie 1.

Furthermore, motorised wheels 44 adapted to support the removable body 32 permanently and to drive it in horizontal translation, are mounted to rotate about pivot pins 38.

FIG. 6 illustrates the unloading of the chassis element 30 (separated from the chassis element 31) as well as the transfer of the removable body 32 onto the platform of the trailer 23, as have been described regarding the first embodiment.

The invention is not limited to the embodiments which have been shown and described in detail hereinbefore, as various modifications may be made thereto without departing from the scope thereof.

What is claimed is:

1. A rail car for the technical coordination of rail-highway transport, intended for transporting removable bodies which constitute rail car superstructure for rail transport and road vehicle infrastructure for highway transport, said car having an infrastructure which comprises, a working chassis adapted to support the load as well as the forces of traction and collision with a buffer, the chassis being divided into at least two elements and each element having a collision end and a separation end, disconnectable connecting means adapted to connect said chassis elements, a rolling element positioned to support each chassis element adjacent its collision end, a retractable support device mounted on each chassis element adjacent its separation end, means on each chassis element for longitudinally guiding a load on said element, means on at least one chassis element for effecting longitudinal movement of a load, and means for actuating said support device to control and determine the height at which said separation end is supported, whereby the separation end of a chassis element can be moved to a position slightly above or below the level of an adjacent road vehicle bed to facilitate the transferring of load to and from said road vehicle.

2. The car of claim 1, wherein the means for connecting the two chassis elements are hooks fitting in one another by vertical translation to ensure locking, the means for lifting the retractable support device of one of said elements also enabling the hooks to be disconnected.

3. The car of claim 1, wherein the device for supporting each of the two chassis elements is equipped with rail wheels adapted to rest on the railway rails and allowing each of said elements to move therealong.

4. The car of claim 1, wherein the traction means cooperating with the means for longitudinally guiding the load of each chassis element is constituted by drive wheels disposed near the separation end and adapted to receive their driving energy from the road vehicle.

5. The car of claim 1, wherein the means for longitudinally guiding the load of each chassis element comprise members for laterally centering the removable bodies.

6. The car of claim 1, wherein each chassis element and the corresponding removable body comprise combined stop and locking means, allowing the positioning of the superstructures relatively to the infrastructures and their mutual connection.

7. The car of claim 1, wherein the device for supporting each of the two elements of the chassis is constituted by a prop articulated around a horizontal axis perpendicularly to the longitudinal axis of the car and located near the separation end, this prop being pivoted by at least one jack abutting on the chassis element in the direction of the rolling element.

* * * * *